United States Patent [19]

Stender et al.

[11] Patent Number: 4,554,816

[45] Date of Patent: Nov. 26, 1985

[54] METHOD FOR THE MANUFACTURE OF A PIPE BEND

[75] Inventors: Erich Stender, Ratingen; Wilhelm G. Fuesers, Duisburg, both of Fed. Rep. of Germany

[73] Assignee: Mannesmann Aktiengesellschaft A.G., Fed. Rep. of Germany

[21] Appl. No.: 392,274

[22] Filed: Jun. 25, 1982

[30] Foreign Application Priority Data

Jul. 7, 1981 [DE] Fed. Rep. of Germany ..... 3127199

[51] Int. Cl.[4] ..... B21C 37/08; B21D 21/00; B21D 5/10; B21H 1/22

[52] U.S. Cl. ..... 72/368; 72/366; 29/157 A; 228/152; 228/173.6

[58] Field of Search ..... 72/51, 52, 367, 368, 72/377, 379, 369; 29/157 A; 228/144, 147, 152, 173 C

[56] References Cited

U.S. PATENT DOCUMENTS

| | | | |
|---|---|---|---|
| 1,623,064 | 4/1927 | Napier | 228/144 |
| 1,840,512 | 1/1932 | Kling | 29/157 A |
| 1,891,338 | 12/1932 | Snell | 29/157 A |
| 2,406,838 | 9/1946 | Kepler | 72/368 |
| 3,129,496 | 4/1964 | Cox | 72/206 |
| 3,499,305 | 3/1970 | Abernathy | 72/197 |

FOREIGN PATENT DOCUMENTS

| | | | |
|---|---|---|---|
| 20339 | 9/1964 | Japan | 72/369 |
| 11111 | 2/1981 | Japan | 72/369 |
| 596314 | 3/1978 | U.S.S.R. | 72/369 |

*Primary Examiner*—Lowell A. Larson

*Attorney, Agent, or Firm*—Oldham, Oldham & Weber Co.

[57] ABSTRACT

The invention relates to a method for the manufacture of a pipe bend, whereby to obtain a uniform wall thickness one starts from a strip or sheet in the butted tube manufacture, the thickness of which constantly changes such that on the butted tube there is in each case respectively a longitudinal line with the greatest and smallest pipe wall thickness, lying opposite each other on the pipe cross section.

2 Claims, 3 Drawing Figures

METHOD FOR THE MANUFACTURE OF A PIPE BEND

Figure 1:
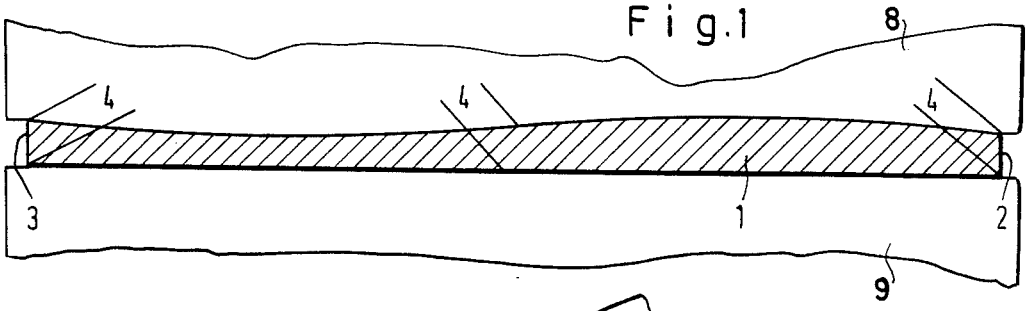

The invention relates to a method for the manufacture of a pipe bend from a pipe, longitudinally semi-welded, produced through rolling of a slab ingot to a strip or sheet, through levelling the strip or sheet, through bending or rolling to a butted tube and welding of the slit, and through bending about an axis vertical or almost vertical to the pipe axis, whereby the pipe is heated progressively on the bend length on a narrow ring and is pressed with axial pressure into a loop.

Pipe bends produced in this way have a thicker wall on the inside of the bend and a thinner wall on the outside than the initial pipe with a uniform wall thickness. The phenomenon is caused by upsetting on the inside of the bend and by extending on the outside of the bend, and is generally felt to be a disadvantage, since the load carrying capacity of the bend is determined by the region of the thinnest wall thickness.

The object of the invention is to produce a pipe bend with a uniform pipe diameter and a distribution of wall thickness on the circumference such that it possesses an optimun load carrying capacity. In particular the wall thickness on the finished bend is to be uniform on the entire pipe circumference. In addition, the position of the longitudinal weld seam on the pipe is of some significance for the load carrying capacity. The invention is therefore based on the additional problem of arranging the manufacture of the initial product simply and at the same time such that any desired position of the longitudinal weld seam on the pipe cross section is possible.

According to an aspect of the invention the uncontrolled upsetting and extending on the pipe bend are successfully countered. If, for example, the straight pipe is arranged, on bending, with its longitudinal line with the smallest pipe wall thickness closest to the bending axis vertical to the pipe longitudinal axis, then with correct measurement of the constantly changing strip thickness a pipe bend can be produced, which possesses a constant wall thickness on the pipe circumference.

The correct measurement of the constantly changing wall thickness is dependent upon the ratio of the means wall thickness to the pipe diameter on the one hand and on the ratio of the pipe diameter to the bending radius on the other. Generally it is such that, in relation to a mean wall thickness, the bulging to the greatest wall thickness exceeds the narrowing to the smallest wall thickness.

The manufacture of a pipe bend with the same load carrying capacity according to the conventional method of manufacture would have to start from a straight pipe with a considerably greater wall thickness. The load carrying capacity of the pipe bend is in this case principally determined by the wall thickness on the outside of the pipe bend. The pipe bend according to the invention is advantageous in many respects in comparison with this. It weighs less, and in particular it avoids superfluous weight which does not contribute to the load carrying capacity of the pipe bend. An insert pipe with a smaller mean wall thickness requires less expenditure of energy on bending for the compressive force and heating. Accordingly it is possible to produce larger pipe bends with a specific machine, which is conducive to reducing the cost of manufacture. Last but not least, technology is also favourably influenced through this in that a pipe bend of the same load carrying capacity can be produced according to the present proposal with a tighter bending radius. Also, according to the present proposal, the position of the weld seam on the pipe bend cross section remains freely selectable despite the constantly changing wall thickness.

In detail, the possibility exists of proceeding with the proposal. In the case of the production of strip or sheet by rolling, the constant alteration in thickness can be produced in the direction of rolling through the roll adjustment (roll gap regulation) or transversely to the direction of rolling through a special roll profiling. The first method is more universally applicable; but restricted to short and medium bend lengths corresponding to the roll body width. The other method is more extensive in terms of dimensions; however, the tool equipment increases, in return, with every pipe diameter or requires an individual tool processing.

A particular working procedure in the method is the levelling of the strip or sheet, indispensable to date and also according to the present proposal. As difficult and impossible as the levelling of a strip or sheet with a changing thickness might appear to be at first sight, it is simple according to the invention herein.

The porposal permits the constant alteration of the strip- or sheet thickness to be distributed such that any desired position of the longitudinal weld seam on the pipe bend cross-section can be produced. With a longitudinal weld seam on the outer or inner pipe bend, symmetrical profiles are used. The longitudinal line of the largest or smallest thickness lies in the longitudinal centre of the strip or sheet. The other longitudinal line in each case coincides with the free edges and the longitudinal weld seam.

If the weld seam is to lie outside the outside or inside of the pipe bend, then a strip or sheet is used, of which the longitudinal lines with the greatest and smallest thickness do not coincide with the free longitudinal edges. In the special case, the longitudinal weld seam is to be situated for instance in the so-called neutral axis on the pipe bend. In the latter case, the constant change in thickness produces an S-profile which is symmetrical in fold about the longitudinal centre. This profile is also particularly favourable for levelling, since a stack can be formed in that each subsequent sheet or strip piece is placed onto the preceding one through folding with rotation through 180° vertically to the surface extent. This is first of the 4 cases in all.

To totally answer the problem posed, an additional step is proposed. This step takes effect above all in that for example in rolling with profiled rolls all desired positions of the longitudinal weld seam can be produced on one set of rolls and from one strip or sheet width. The discarded edge strip which arises through this is often more economical, evaluating its scrap value, than the provision of innumerable sheet and strip widths.

The above conditions can, for example, also be reached with the rolls breadthwise having a profiling with a repetition up to one half cycle and the strip or sheet is rolled from the width corresponding to the pipe circumference aligned to the roll profiling with lateral guidance.

Finally, provision can also be made that multiple profilings are provided on the roll, the strip and sheet are rolled on the total width and before or after levelling are slit lengthwise. This and other modification of the proposal through the manufacture of the same or different sheets with constantly changing thickness for the manufacture of butted tubes from a slab ingot or a rolled sheet or strip lie within the scope of the present proposal.

Figure 2:
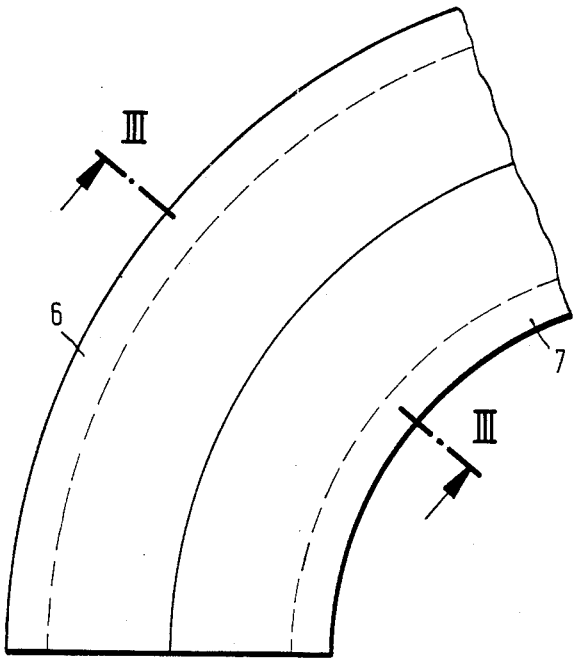
Figure 3:
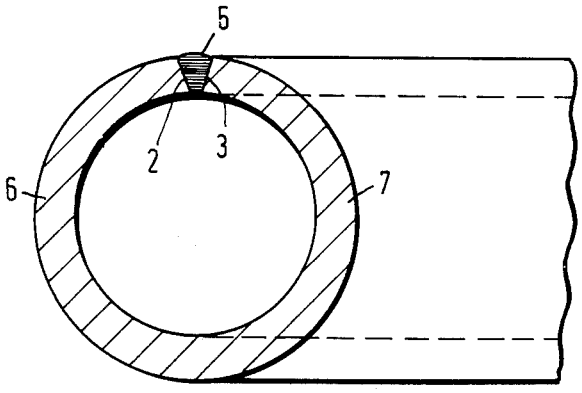

An example embodiment of the object of the invention is shown diagrammatically in FIGS. 1 to 3. These show in detail:

FIG. 1 a cross section through a sheet

FIG. 2 the top view onto the pipe bend

FIG. 3 the cross section indicated in FIG. 2 through the pipe of the bend.

This is a pipe bend with a constant wall thickness on the pipe circumference and a weld seam lying approximately in the neutral bending zone. The sheet 1 in FIG. 1 serving for the manufacture of butted tubes, is produced with an equal thickness 4 on both edges 2, 3.

The sheet has the same thickness 4 in the cross-section centre. The left half is thinner and later becomes the inside of the pipe bend; the right half is thicker and later becomes the outside of the pipe bend. The difference in thickness, according to the pipe diameter and the bending radius amounts to about or up to approximately 1/5 of the mean sheet thickness. The difference from the mean sheet thickness can be (thinner) greater on the left half of the sheet than on the right side (thicker).

A butted pipe is formed from the sheet such that the edge 2 and 3 lie opposite each other. The pipe cross section is closed for example with arc fusion welding 5. Depending on the quality requirement, there then follow, if required, further finishing to the weld seam and an annealing operation.

The pipe is then taken onto the bending device and aligned according to the wall thickness and hence at the same time according to the weld seam 5 and is bent. The bending takes place in the example in FIG. 2 about an axis vertical to the plane of the paper and respectively in FIG. 3 about an axis vertical in the plane of the paper. Thereby the wall thickness 6 on the outside of the pipe bend has diminished in comparison with the sheet thickness on the right side in FIG. 1. At the same time, the wall thickness 7 on the inside of the pipe bend has increased in comparison with the sheet thickness on the left side in FIG. 1. The weld seam 5 has undergone practically no alteration in wall thickness, so that the wall thickness on the pipe circumference along the bend is constant, as has been aimed for in this example. The constant changing of the thickness of the strip or sheet is produced by hot rolling with cylindrical rolls 8, 9 contoured to obtain the desired changing thickness as shown in FIG. 1.

We claim:

1. A method for the manufacture of a pipe bend from a longitudinally seam welded pipe comprising rolling a slab ingot to form a sheet, bending the resulting sheet to form a butted tube having a longitudinal slit, welding the slit, and bending the pipe about an axis which is substantially perpendicular to a longitudinal plane passing through the axis of the pipe, characterized in that said slab ingot is rolled in such manner that the thickness of the resulting sheet varies, from one side edge to the other, by first decreasing continuously from the thickness at one edge to a minimum thickness, then increasing continuously from said minimum to a maximum, and then decreasing continuously from said maximum to the thickness at said one side edge, and said pipe is aligned for bending so that the thinner portion of the pipe is toward the bending axis and the thicker portion is away from the bending axis, whereby a pipe having substantially uniform wall thickness along a circumference at the bend is obtained.

2. A method according to claim 1 wherein said slab ingot is hot rolled between cylindrical rolls which are contoured to produce the desired variable sheet thickness.

* * * * *